US010926547B2

(12) United States Patent
Murphy et al.

(10) Patent No.: US 10,926,547 B2
(45) Date of Patent: Feb. 23, 2021

(54) CLOSURE DEVICES

(71) Applicant: HEWLETT-PACKARD DEVELOPMENT COMPANY, L.P., Spring, TX (US)

(72) Inventors: Bryan Murphy, Leixlip (IE); SeeMun Phoong, Leixlip (IE); John Enright, Leixlip (IE); James Mannion, Leixlip (IE)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/481,595

(22) PCT Filed: Apr. 24, 2017

(86) PCT No.: PCT/US2017/029104

§ 371 (c)(1),
(2) Date: Jul. 29, 2019

(87) PCT Pub. No.: WO2018/199885

PCT Pub. Date: Nov. 1, 2018

(65) Prior Publication Data

US 2019/0344572 A1 Nov. 14, 2019

(51) Int. Cl.
*B41J 2/175* (2006.01)

(52) U.S. Cl.
CPC ..... *B41J 2/1754* (2013.01); *B41J 2/17506* (2013.01); *B41J 2/17513* (2013.01)

(58) Field of Classification Search
CPC .. B41J 2/1754; B41J 2/17506; B41J 2/17513; B41J 2/17556; B41J 2/17559
See application file for complete search history.

(56) References Cited

U.S. PATENT DOCUMENTS

| | | | | |
|---|---|---|---|---|
| 4,771,295 | A | 9/1988 | Baker et al. | |
| 5,216,450 | A | 6/1993 | Koitabashi et al. | |
| 5,415,487 | A * | 5/1995 | Rukan | B43K 7/02 401/109 |
| 5,801,737 | A | 9/1998 | Sato et al. | |
| 6,273,562 | B1 * | 8/2001 | Deshmukh | B41J 2/17503 347/86 |
| 7,159,974 | B2 | 1/2007 | Gray et al. | |
| 7,188,937 | B2 | 3/2007 | Wilson et al. | |
| 2005/0168540 | A1 | 8/2005 | Wilson | |
| 2009/0096836 | A1 | 4/2009 | Haines | |
| 2009/0122121 | A1 | 5/2009 | Kawasaki | |
| 2012/0182364 | A1 | 7/2012 | Takeda | |
| 2017/0087858 | A1 | 3/2017 | Hayashi | |

FOREIGN PATENT DOCUMENTS

| | | | | |
|---|---|---|---|---|
| EP | 1095792 A2 * | 5/2001 | | B43K 5/1827 |

* cited by examiner

*Primary Examiner* — Huan H Tran
(74) *Attorney, Agent, or Firm* — HP Inc. Patent Department

(57) ABSTRACT

In an example, there is provided a closure device. The closure device comprises an air-permeable and ink-impermeable membrane to prevent ink egress from a refillable ink tank of a printer. The membrane has an ink tank side and an air side. The closure device also comprises a tortuous air flow path connecting the air side of the membrane to an exterior of the ink tank.

20 Claims, 4 Drawing Sheets

CLOSURE DEVICES

BACKGROUND

In printing, print agents such as inks or toners (generally, 'print agents') may be applied to a substrate. In some examples, print agents may be stored in refillable tanks of a printer to print onto substrates. Such examples may be referred to as continuous ink supply systems. Refillable tanks may have apertures for refilling the tank which may need to be closed.

BRIEF DESCRIPTION OF DRAWINGS

Non-limiting examples will now be described with reference to the accompanying drawings, in which.

DETAILED DESCRIPTION

In some print apparatus, a pattern of print agent may be printed on a substrate by depositing print agents, such as inks, toners, coatings or the like, onto the substrate. Print agents may be two-dimensional print agents such as those for printing on flat substrates, or may be three-dimensional print agents, such as those for additive manufacture. The various print agents may be stored in tanks of a printer from which print agent can be drawn and fed to the print head of the printer to print. Systems of this type may be referred to as continuous ink supply systems. The features of the present disclosure may be implemented in such continuous ink supply systems.

For the purposes of this detailed description, the print agent stored in the tank or tanks of the printer will be described as an ink for brevity. Of course, it should be understood that the examples described herein may be equally applicable to other types of print agents, such as two-dimensional or three-dimensional print agents.

In some examples, pressure gradients may be formed between the interior of a refillable print agent tank and the atmosphere which can cause printing errors. In some examples, a refillable print agent tank of a printer may be sealed to prevent print agent egress from the tank.

Figure 1:
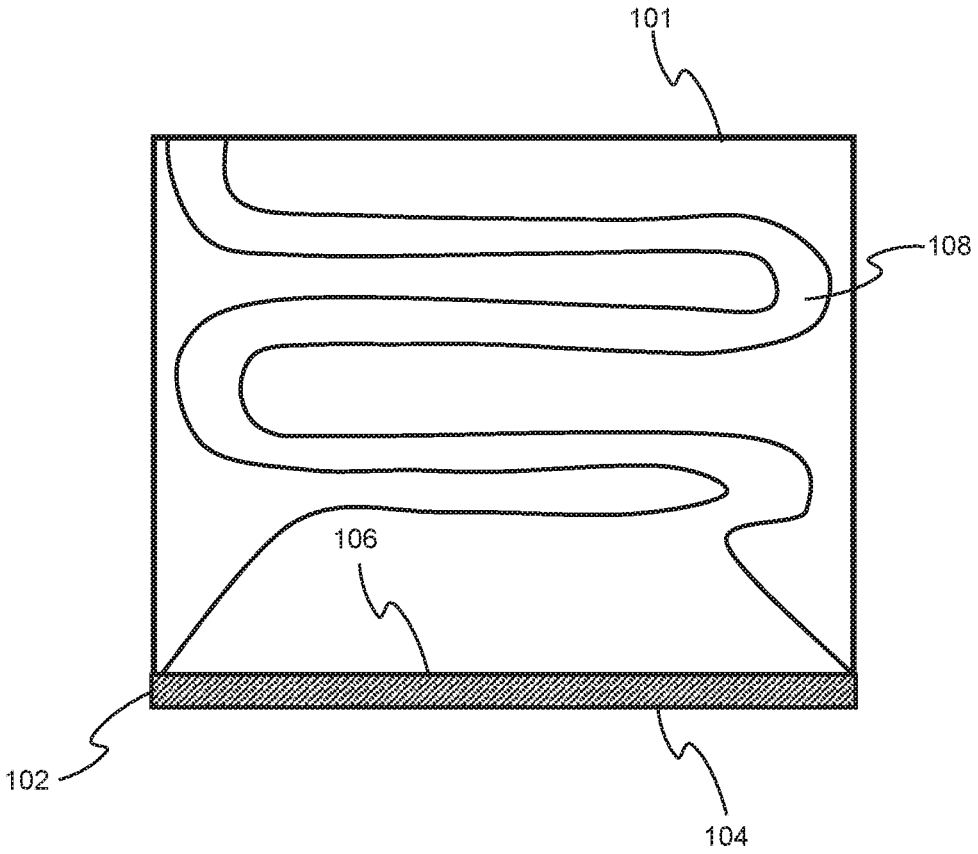
FIG. 1 is a schematic representation of an example closure device.

FIG. 1 is an example of a closure device 101. The closure device 101 comprises an air-permeable and a print-agent-impermeable membrane 102 to prevent print agent egress from a refillable print agent tank of a printer. The membrane has an print agent tank side 104 and an air side 106. The closure device 101 also comprises a tortuous air flow path 108 connecting the air side 106 of the membrane to an exterior of the print agent tank.

When compared to systems having other arrangements, the membrane 102 and tortuous airflow path 108 of the closure device 101 result in improved resistance to egress of print agent through the closure device 101 while also resulting in reduced moisture evaporation through the closure device 101.

Figure 2:
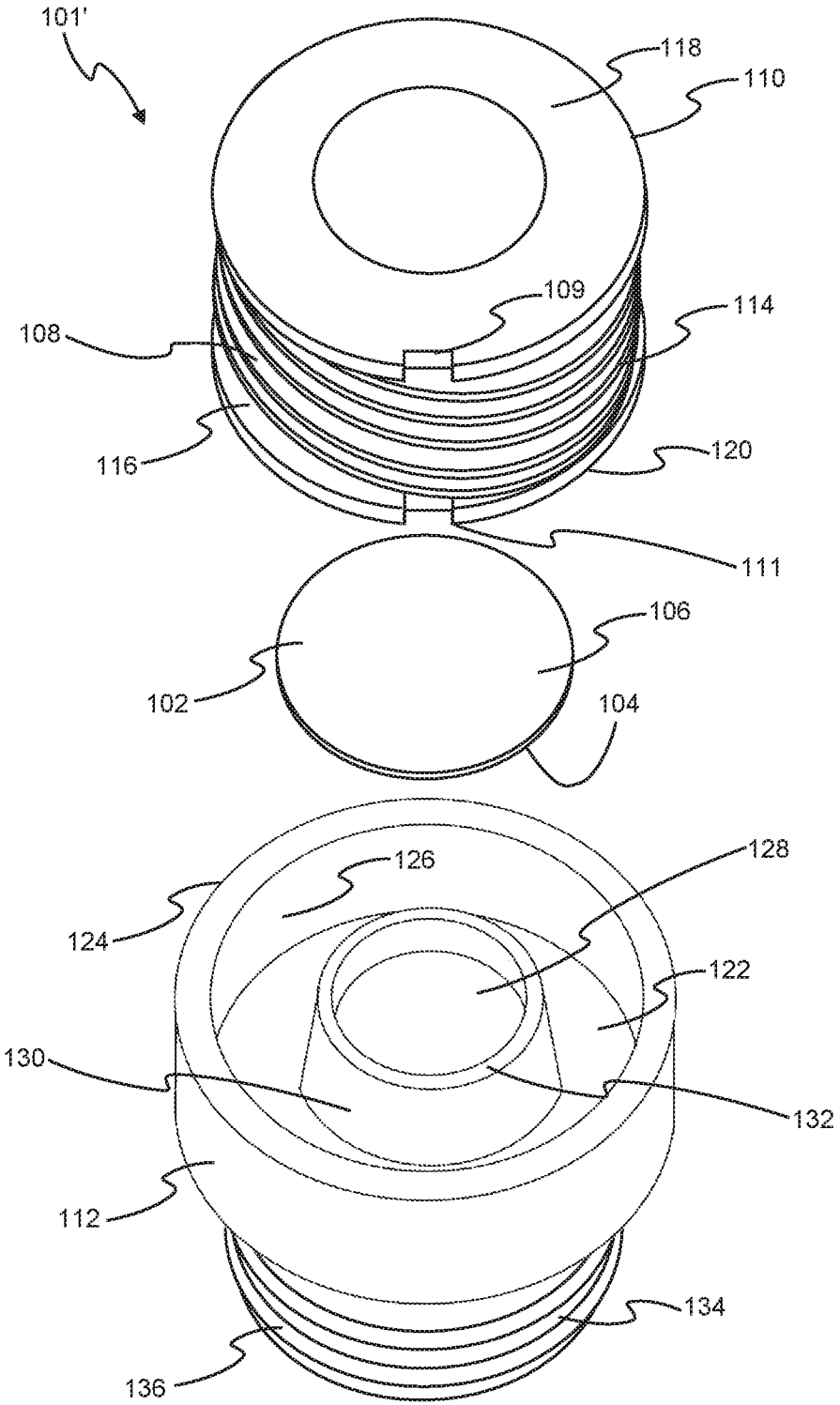
FIG. 2 is an example of a closure device shown in an exploded view.

FIG. 2 is another example of a closure device 101', the closure device 101' comprises a first part 110 and a second part 112 and the first part 110 is engageable with the second part 112. The first part 112 may be a cap-shaped part which comprises an annular cylindrical wall 116 and a lid 118 which closes a top end of the annular cylindrical wall 116. In some examples, the first part 110 is receivable in the second part 112. In such examples, an open end 120 of the first part opposite the lid 118 may be inserted into a corresponding opening 122 of the second part 112 and received therein. The opening 122 of the second part 112 may be substantially cylindrical. The external diameter of the first part 110 may be substantially similar to an internal diameter of the opening 122 of the second part 112 such that the first part 110 can be retained within the second part 112 by friction.

In the example of FIG. 2, the first part 110 comprises a surface feature 114 which cooperates with second part 112 when the first and second parts 110, 112 are engaged to define the tortuous air flow path 108 between the first and second parts 110, 112. In some examples, the surface feature 114 is formed on an outer surface of the annular cylindrical wall 116 of the first part 110. In some examples, when the first part 110 is received in the opening 122 of the second part 112, the surface feature 114 on the outer surface of the wall 116 may be in contact with an inner surface 126 of an annular cylindrical wall 124 of the second part 112 which defines the opening 122. The surface feature 114 may be an open channel and the surface 126 may close the open channel to thereby form the tortuous air flow path 108.

In this example, the surface feature 114 is a helical feature which, when the first and second parts 110, 112 are engaged, defines a helical air flow path 108 between the first and second parts 110, 112. In this example, the surface feature is a helical thread protruding from the outer surface of the wall 116 which defines a helical open channel about the first part 110. The helical open channel may be closed by the inner surface 126 of the second part 112 to form a helical flow path 108. In some examples, the helical feature 114 may be formed on the inner surface 126 of the second part 112 instead. However, the helical feature 114 being formed on the outer surface of the wall 116 of the first part 110 may result in a more easily manufactured closure device, as it may be easier to form protruding features on an external surface than an internal surface. Furthermore, less stress may be applied to the helical feature when it is formed on the first part 110 than the second part 112 as the second part is handled and may be compressed during insertion or removal of the closure device.

In this example, the first part 110 comprises an outer opening 109 which permits communication between the tortuous air flow path 108 and the atmosphere. The first opening 109 may be a notch or recess formed at a periphery of the lid 118 of the first part 110 which, when the first part 110 is received in the second part 112, forms an atmospheric vent at a first end of the tortuous flow path 108. In some examples, the first part 110 may comprise an inner opening 111 which permits communication between the tortuous air flow path 108 and the air side 106 of the membrane 102. The second opening 111 may be a notch or recess formed at a periphery of the wall 116 of the first part 110 which, when the first part 110 is received in the second part 112, forms an opening at a second end of the tortuous flow path 108 which is in communication with the air side 106 of the membrane 102.

In this example, the membrane 102 is accessible when first and second parts 110, 112 are disengaged. The second part 112 comprises an aperture 128 which is in communication with the interior of a printer ink tank. The aperture 128 may be surrounded by an a wall 130 which forms a membrane seat 132 on an end thereof. The membrane 102 is be retained on the membrane seat, for example by heatstaking, to form a continuous seal about the aperture 128. The ink side 104 of the membrane 102 is arranged in communication with an ink tank via the aperture 128 and the air side 106 of the membrane may be in communication with the tortuous air flow path 108. The membrane 102 is air-permeable and ink-impermeable and so air may travel through the aperture 128 from the ink tank to the interior of the closure device 101, while ink may not travel through the aperture 128 from the ink tank to the interior of the closure device 101'. Accordingly, ink may be prevented from escaping from an ink tank via the closure device 101', and may be prevented from entering the tortuous air flow path 108 by the membrane 102.

In this example, the second part 112 of the closure device 101 may comprise a sealing element 134 to form a seal between the closure device 101 and an ink tank of a printer. The sealing element 134 may comprise raised sealing ridges 136 which are of a greater diameter than a diameter of an opening of an ink tank to be closed by the closure device 101'. The sealing element 134 may be constructed from a resiliently deformable material. In some examples, the sealing element 134 may be a separate component of the closure device 101' which is retained on the second part 112 and may be replaced.

The first and second parts 110, 112 of the closure device 101 being engaged together will result in the tortous flow path being formed entirely within the closure device 101. In some examples, the first and second parts 110, 112 may be secured together once they have been engaged. In other examples, the first and second parts 110, 112 may be disengageable. Accordingly, if a failure of the membrane 102 occurs and ink enters the tortuous flow path, then the two parts can be disengaged to allow replacement of the membrane 102 and cleaning of the tortuous flow path 108.

Figure 3:
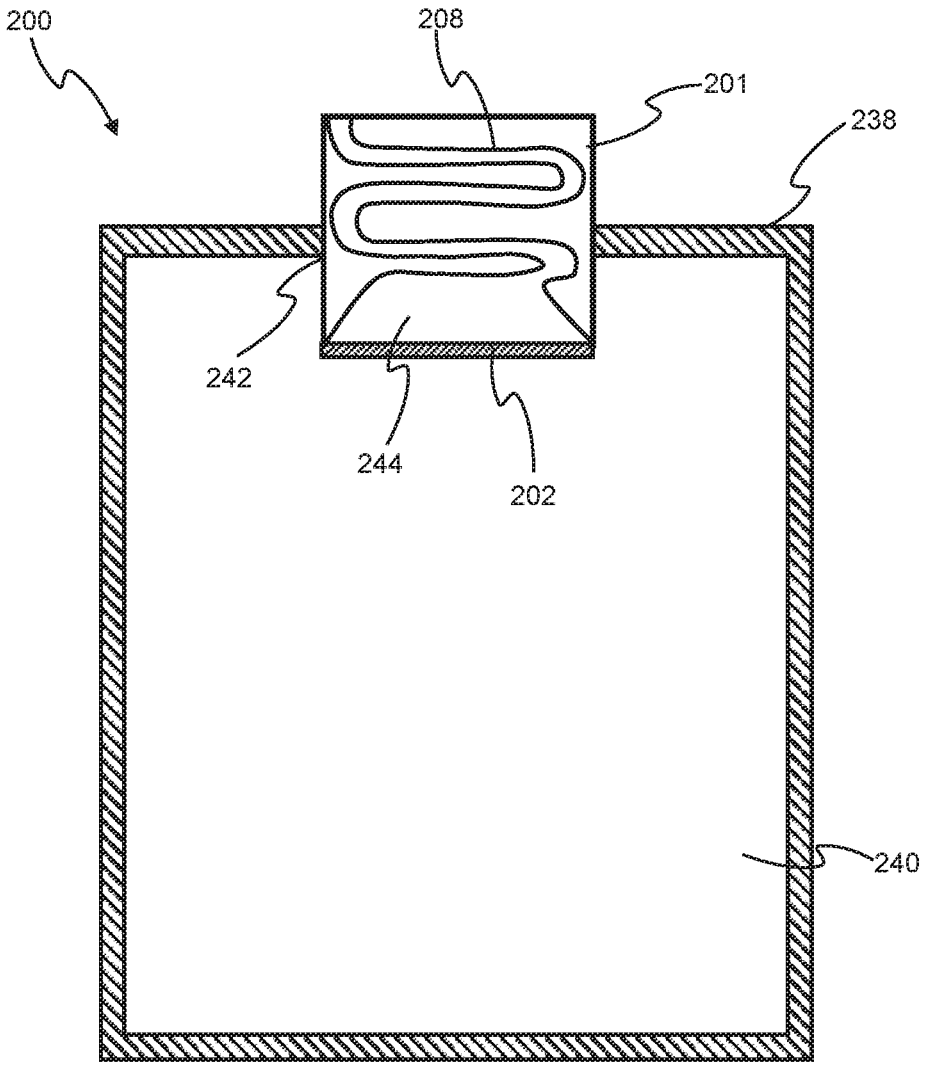
FIG. 3 is a schematic representation of an example refillable tank apparatus.

FIG. 3 is an example of a refillable printer print agent tank apparatus 200. The apparatus 200 comprises a refillable print agent tank 238 having a print agent chamber 240 and a refilling aperture 242. The apparatus 200 further comprises a closure bung 201 to close the refilling aperture 242. The closure bung 201 comprises a print agent barrier membrane 202 to separate the print agent chamber 240 of the print agent tank 238 from an interior 244 of the closure bung 201, and a labyrinthine air flow channel 208 formed between the interior 244 of the closure bung 201 and an exterior of the print agent tank apparatus 200.

In some examples, the refillable printer print agent tank apparatus 200 may form part of a continuous ink supply system.

Figure 4:
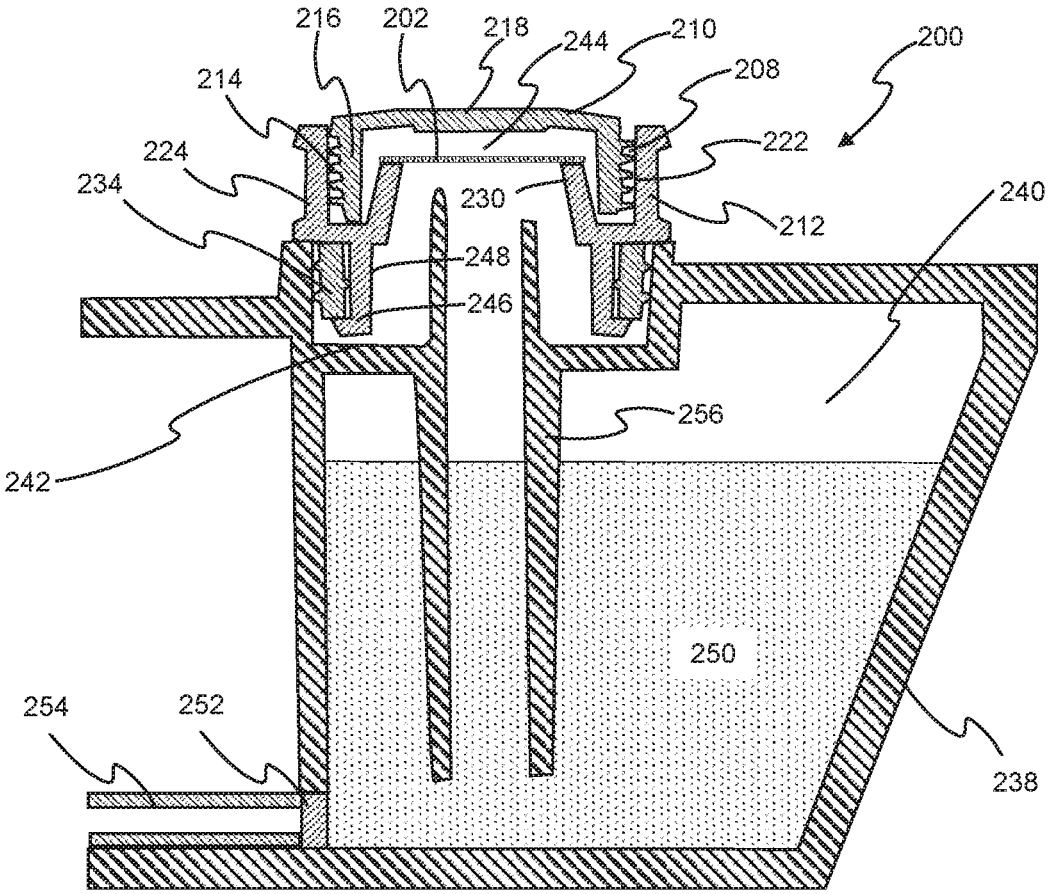
FIG. 4 is an example of a refillable tank apparatus shown in a sectional view.

FIG. 4 shows another example of a refillable printer ink tank apparatus 200'. In this example, the closure bung 201 comprises a body 212 to engage with and close the refilling aperture 242 and a cap 210 receivable in the body 212. In some examples, the cap 210 may comprise an tubular wall 216 which is closed at an upper end by a cover 218. The diameter of the cover 218 may be larger than the diameter of the tubular wall 216. In some examples, the body 212 may comprise a receiving opening 222 to receive the cap 210. The receiving opening 222 may be formed by an annular wall 224 of the body 212. An inner diameter of the annular wall 224 may be substantially equal to an outer diameter of the closure bung 201 such that the bung 201 can be retainably received in the receiving opening 222 of the body. The body 212 of the bung 201 may further comprise a sealing element 234 which is arranged about an insert portion 246 of the body 212 which is insertable into the refilling aperture 242 to thereby close the aperture 242. The insert portion 246 may comprise a central bore 248 which, when the closure bung 201 closes the refilling aperture 242, is in communication with the ink chamber 240 and the membrane 202.

In this example, the labyrinthine air flow channel 208 is formed between the body 212 and the cap 210 of the closure bung 201. A protruding feature 214 on the tubular wall 216 of the cap 210 may be formed to thereby form the labyrinthine air flow channel 208 in an annular space between the annular wall 224 of the body 212 and the tubular wall 216 of the cap 210. In some examples, the protruding feature 214 may be formed on the annular wall 224 to form the labyrinthine air flow channel 208.

In this example, one of the body 212 and the cap 210 comprises a screw thread-like feature 214 on a surface thereof which engages with a surface of the other of the body 212 and the cap 210 to form the labyrinthine air flow channel 208. The cap 210 may comprise a screw thread-like protruding feature 214 which extends helically about the tubular wall 216 of the cap 210. Accordingly, when the cap 210 is received in the body 212 of the closure device 201, the labyrinthine air flow channel 208 may be helical in shape within the annular space between the walls 216,224.

In some examples, the cap 210 of the closure bung 201 may be removable from the body 212 of the closure bung 201 to permit replacement of the membrane 202. In other examples, the cap and the body may be secured together once they are engaged. The interior 244 of the bung 201 may be an internal chamber formed in the closure bung 201 between the body 212 and the cap 210 when these parts are engaged. The membrane 202 can separate the interior 244 of the bung 201 from the ink chamber 240 of the ink tank 238. Accordingly, the membrane 202 being an ink barrier may permit air flow from the ink chamber 240 to the interior of the bung 201 while preventing ink flow from the ink chamber 240 to the interior of the bung 201. The membrane 202 may be arranged on a raised internal portion 230 of the body 212 to seal the raised internal portion 230. The membrane 202 may therefore be accessible when the cap 210 is not engaged with the body 212 via the opening 222.

The labyrinthine air flow channel 208 may be in communication at a first end to the interior 244 of the bung 201 and at a second end to the atmosphere. As the membrane 202 can permit air flow from the ink chamber 240 to the interior 244 of the bung 201 while preventing ink flow, air flow between the atmosphere and the ink chamber 240 to the atmosphere can take place through the bung 201 while ink flow cannot.

In this example, the ink tank 238 may be integral to a printer. A volume of ink 250 may be contained within the ink chamber 240 of the ink tank 238. A valve 252 may be arranged in communication with the ink chamber 240 to selectively permit ink 250 to be drawn from the ink chamber 240 into an ink conduit 254 which may be connected to a print head of a printer, for example. The ink tank 238 may comprise a filling tube 256 which extends both into the ink chamber 240 and out of the filling aperture 242. When the closure bung 201 is not closing the aperture 242, ink 250 can be provided to the ink chamber 240 via the filling tube 256.

Figure 5:
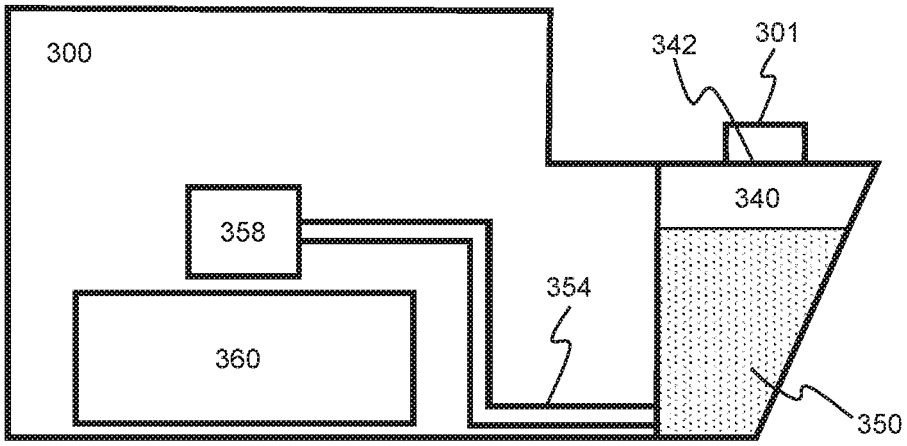
FIG. 5 is a schematic representation of an example of a printer.

FIG. 5 is an example of a printer 300. The printer 300 comprises an integrally formed chamber 340 to contain print agent 350. The printer 300 also comprises a replenishment hole 342 through which print agent 350 can be added to the chamber 340. The printer also comprises a removable sealing member 301 to seal the replenishment hole 342. The sealing member 301 comprises a serpentine flow passage in communication with the atmosphere external to the print agent chamber 340 and with the print agent chamber chamber 340. The sealing member 301 further comprises a membrane to permit air flow and prevent ink flow between the atmosphere and the print agent chamber via the serpentine flow passage.

In this example, the print agent chamber 340 may be constructed as per the print agent chamber of FIG. 2 or 3. In some examples, the print agent chamber and sealing member of the printer 300 may be constructed as per the comprise an print agent tank apparatus of FIG. 2 or 3.

In some examples, the serpentine flow passage may be constructed as per the air flow path of FIG. 1 or 2 or the air flow channel of FIG. 3 or 4.

In some examples, the removable sealing member 301 comprises a housing and a plug receivable in the housing. In some examples, the removable sealing member 301 may be constructed as per the closure device of FIG. 1 or 2, or the closure bung of FIG. 3 or 4. In some examples, the housing of the sealing member 301 may be constructed as per the second part of FIG. 1 or 2 or the body of FIG. 3 or 4. In some examples, the plug of the sealing member 301 may be constructed as per the first part of FIG. 1 or 2 or the cap of FIG. 3 or 4.

In some examples, the plug or the housing comprises a channel formed on a surface thereof which, when the plug is received in the housing, forms the serpentine flow passage between the housing and the plug.

In some examples, the channel is a helical channel which, when the plug is received in the housing forms a helical flow passage between the housing and the plug.

In some examples, the plug may be removable from the housing to allow access to the membrane. In other examples, the plug and housing may be secured together once they have been engaged.

The printer 300 may comprise a print agent supply duct 354 along which print agent 350 can be drawn from the print agent chamber 340 and supplied to a print head 358 of the printer 300. The print head 358 can print print agent onto a substrate 360. The printer may be a two-dimensional printer or a three-dimensional printer.

While the aspects have been described with reference to certain examples, various modifications, changes, omissions, and substitutions can be made without departing from the spirit of the present disclosure. It is intended, therefore, that the method, apparatus, and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A closure device to be received in and close a refilling aperture of a refillable print agent tank of a printer, the closure device comprising:

an air-permeable and print-agent-impermeable membrane to prevent ink egress from the refillable print agent tank of a printer, the membrane having an print agent tank side and an air side;

a tortuous air flow path connecting the air side of the membrane to an exterior of the print agent tank;

a first part comprising the membrane; and a second part to receive the first part therein;

an exterior of the second part engageable in the refilling aperture.

2. A closure device as claimed in claim 1, wherein the first part comprises a surface feature which cooperates with an interior surface of the second part when the first and second parts are engaged to define the tortuous air flow path between the first and second parts.

3. A closure device as claimed in claim 2, wherein the surface feature is a helical feature which, when the first and second parts are engaged, defines a helical air flow path between the first and second parts.

4. A closure device as claimed in claim 1, wherein the membrane is accessible when first and second parts are disengaged.

5. The closure device as claimed in claim 1, further comprising raised sealing ridges on the exterior of the second part to engage an interior of, and seal, the refilling aperture.

6. The closure device as claimed in claim 5, wherein the raised sealing ridges are resiliently deformable.

7. The closure device as claimed in claim 1, wherein the second part comprises a wall around an aperture through the second part, the first part surrounding the wall when engaged in the second part.

8. The closure device as claimed in claim 7, wherein the wall comprises a membrane seat, the membrane disposed on the membrane seat.

9. The closure device as claimed in claim 8, further comprising the membrane being heat-staked to the membrane seat.

10. A refillable printer print agent tank apparatus comprising a refillable print agent tank having a print agent chamber and a refilling aperture; and a closure bung to close the refilling aperture comprising:

a print agent barrier membrane to separate the print agent chamber of the print agent tank from an interior of the closure bung, and a labyrinthine air flow channel formed between the interior of the closure bung and an exterior of the print agent tank apparatus;

wherein the closure bung comprises a body to engage with and close the refilling aperture.

11. A refillable printer print agent tank apparatus as claimed in claim 10, further comprising a cap receivable in the body.

12. A refillable printer print agent tank apparatus as claimed in claim 11, wherein the labyrinthine air flow channel is formed between the body and the cap of the closure bung.

13. A refillable printer print agent tank apparatus as claimed in claim 12, wherein one of the body and the cap comprises a screw thread-like feature on a surface thereof which engages with a surface of the other of the body and the cap to form the labyrinthine air flow channel.

14. A refillable in tank apparatus as claimed in claim 11, wherein the cap of the closure bung is removable from the body of the closure bung to permit replacement of the membrane.

15. A refillable printer print agent tank apparatus as claimed in claim 10, further comprising raised sealing ridges on an exterior of the closure bung to engage an interior of, and seal, the refilling aperture.

16. A printer comprising:

an integrally formed print agent chamber to contain print agent;

a replenishment hole through which print agent can be added to the chamber; and a removable sealing member to seal the replenishment hole, the sealing member comprising:

a serpentine flow passage in communication with an atmosphere external to the print agent chamber and with the print agent chamber;

a membrane to permit air flow and prevent print agent flow between the atmosphere and the print agent chamber via the serpentine flow passage; and raised sealing ridges on the exterior of the removable sealing member to engage an interior of and seal the replenishment hole.

17. A printer as claimed in claim 16, wherein the removable sealing member comprises a housing and a plug receivable in the housing.

18. A printer as claimed in claim 17, wherein the plug or the housing comprises a channel formed on a surface thereof which, when the plug is received in the housing, forms the serpentine flow passage between the housing and the plug.

19. A printer as claimed in claim 18, wherein the channel is a helical channel which, when the plug is received in the housing forms a helical flow passage between the housing and the plug.

20. A printer as claimed in claim 17, wherein the plug is removable from the housing to allow access to the membrane.

* * * * *